US007520818B2

(12) United States Patent
Winchester

(10) Patent No.: US 7,520,818 B2
(45) Date of Patent: Apr. 21, 2009

(54) BALL THROWING DEVICE

(75) Inventor: Stephen R. Winchester, Seattle, WA (US)

(73) Assignee: Hyper Products, Inc., Wayzata, MN (US)

( * ) Notice: Subject to any disclaimer, the term of this patent is extended or adjusted under 35 U.S.C. 154(b) by 306 days.

(21) Appl. No.: 11/377,739

(22) Filed: Mar. 16, 2006

(65) Prior Publication Data

US 2006/0281574 A1 Dec. 14, 2006

Related U.S. Application Data

(60) Provisional application No. 60/662,630, filed on Jun. 10, 2005.

(51) Int. Cl.
*A63B 53/00* (2006.01)
*A63B 59/00* (2006.01)

(52) U.S. Cl. ..... 473/282; 473/505

(58) Field of Classification Search ..... 273/317; 124/5; 473/282, 505, 513; 119/702, 707; 294/19.1

See application file for complete search history.

(56) References Cited

U.S. PATENT DOCUMENTS

| | | | | | |
|---|---|---|---|---|---|
| 491,558 | A * | 2/1893 | Hill | 124/5 |
| 1,075,041 | A * | 10/1913 | Kirkness | 124/5 |
| 1,585,446 | A * | 5/1926 | Warwick | 124/5 |
| 2,157,415 | A * | 5/1939 | Jones | 473/235 |
| 2,465,124 | A * | 3/1949 | Sante | 473/235 |
| 2,856,190 | A * | 10/1958 | Sante | 473/235 |
| 2,935,323 | A * | 5/1960 | Cummings | 273/129 R |
| 3,206,202 | A * | 9/1965 | Evans | 473/127 |
| D203,281 | S * | 12/1965 | Reed | D21/720 |
| 3,428,036 | A * | 2/1969 | Parker | 124/5 |
| 3,539,186 | A * | 11/1970 | Batten | 124/5 |
| 3,589,349 | A * | 6/1971 | Parker | 124/5 |
| 4,085,936 | A * | 4/1978 | Patterson | 473/235 |
| 4,548,413 | A * | 10/1985 | David | 473/173 |
| 4,860,717 | A | 8/1989 | Powell et al. | 124/7 |
| 4,922,884 | A | 5/1990 | Ford | 124/20.1 |
| 4,974,574 | A * | 12/1990 | Cutlip | 124/5 |
| 5,004,239 | A * | 4/1991 | Wettstein | 473/282 |
| 5,522,372 | A * | 6/1996 | Gerstikov | 124/5 |
| 6,076,829 | A | 6/2000 | Oblack | 273/317 |
| 6,193,620 | B1 | 2/2001 | Tarng | 473/465 |
| D484,938 | S * | 1/2004 | Tu | D21/789 |
| 6,718,961 | B1 | 4/2004 | Woods et al. | 124/7 |
| 7,032,583 | B1 * | 4/2006 | Hall | 124/5 |
| 2004/0077255 | A1 | 4/2004 | Tarng et al. | 446/46 |

FOREIGN PATENT DOCUMENTS

| | | | |
|---|---|---|---|
| GB | 2112290 | A * | 7/1983 |

* cited by examiner

*Primary Examiner*—Raleigh W. Chiu
(74) *Attorney, Agent, or Firm*—Westman, Champlin & Kelly, P.A.; Z. Peter Sawicki

(57) ABSTRACT

A ball launching device for launching a ball includes a shaft and a head attached to the shaft. The head includes a face having a socket for releasably retaining the ball such that when the head is swung, the ball is released.

8 Claims, 4 Drawing Sheets

BALL THROWING DEVICE

CROSS-REFERENCE TO RELATED APPLICATION

The present application is based on and claims the benefit of U.S. provisional patent application Ser. No. 60/662,630, filed Mar. 16, 2005, the content of which is hereby incorporated by reference in its entirety.

FIELD OF THE INVENTION

The present invention relates to a device for throwing a ball, and in particular, it relates to a device with which a ball is held at the end of a shaft and is launched during a swing of the shaft.

BACKGROUND OF THE INVENTION

Throwing a ball to a dog so that the dog retrieves the ball for the dog owner is great exercise for the dog. However, the dog never seems to tire running after the ball and retrieving it which can be tiring for the dog owner. Also, it is desirable to throw the ball a long distance. Depending on the dog owner, this is often times not possible. Furthermore, throwing a ball a long distance can be difficult and throwing a ball a long distance repeatedly can be very tiring.

Some dog owners have resorted to using a bat or a tennis rack for hitting the ball great distances. However, this takes some coordination. Still other individuals have used catapults or sporting devices intended for other sports. Another device for throwing a ball is shown in U.S. Pat. No. 6,076,829.

SUMMARY OF THE INVENTION

The present invention includes a ball launching device. The device includes a shaft and a head attached to the shaft. The head includes a face having a socket for releasably retaining the ball such that when the device is swung, the ball is released.

DETAILED DESCRIPTION OF ILLUSTRATIVE EMBODIMENTS

Figure 1:
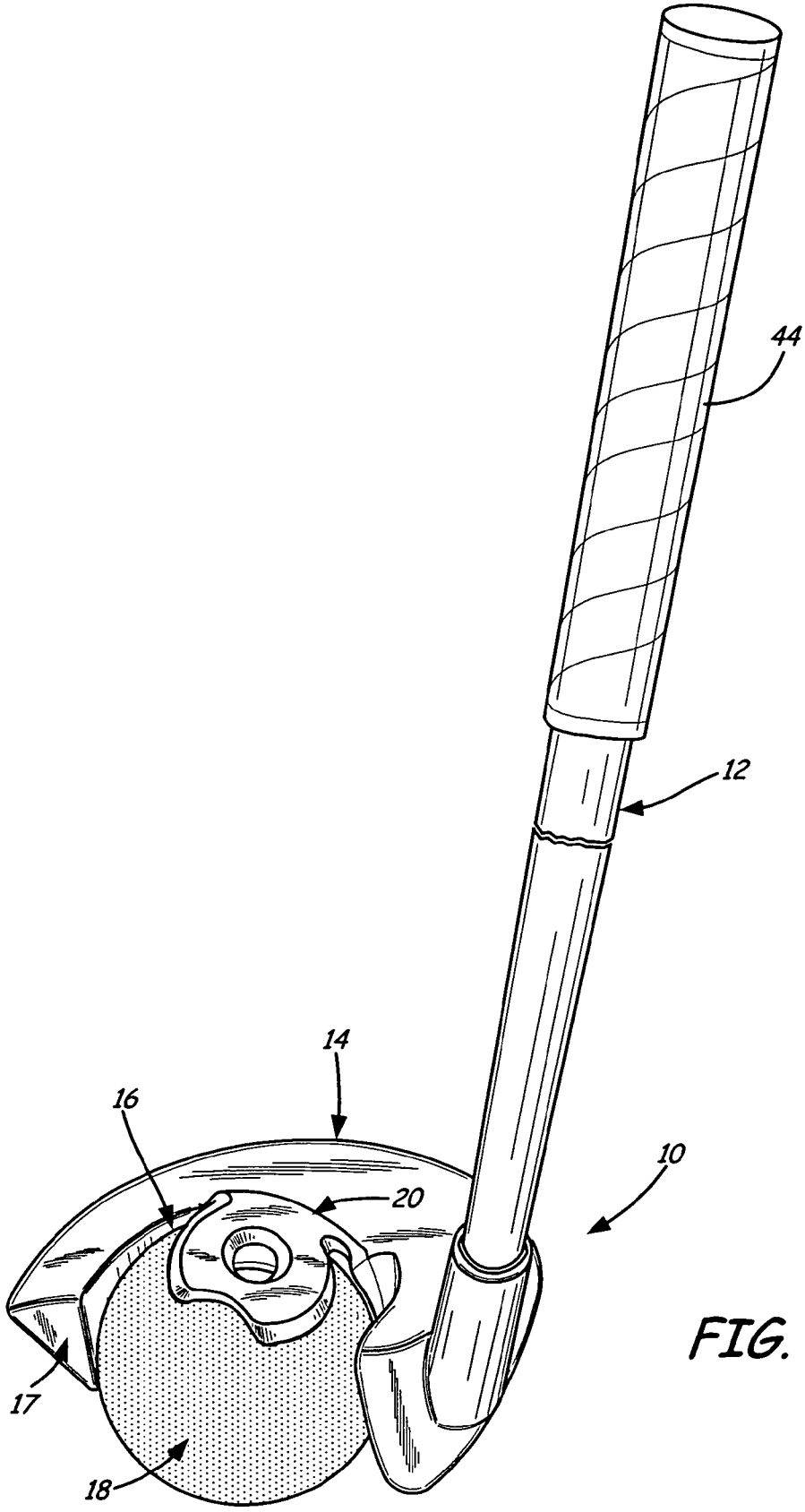
FIG. 1 is a perspective view of the device of the present invention.

The present invention includes a ball launching device generally indicated at 10 in FIG. 1. The ball launching device 10 is designed to look and function much like a golf club. The device 10 includes a shaft 12 attached to a head 14. The head 14 includes a face portion 17 having a socket 16 sized to hold a ball 18. The socket 16 is generally positioned between a toe portion 19 of the club and a heel portion 21 of the club.

The club head 14 is preferably made of a plastic material and is integrally molded as one piece. The shaft 12 is similar to a golf club shaft and can be made of metal or graphite composite or any other material suitable for a golf shaft. Positioned on an upper portion of the shaft is a handle section 44 comprised of a grip that is the same or similar to a golf club grip.

Figure 2:
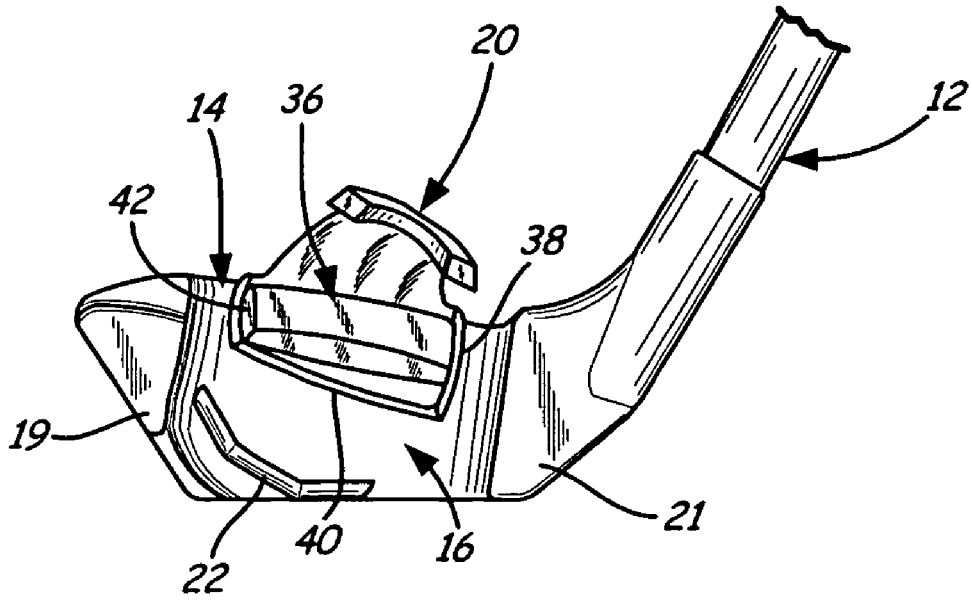
FIG. 2 is a side elevational view of the head portion of the device of the present invention.
Figure 3:
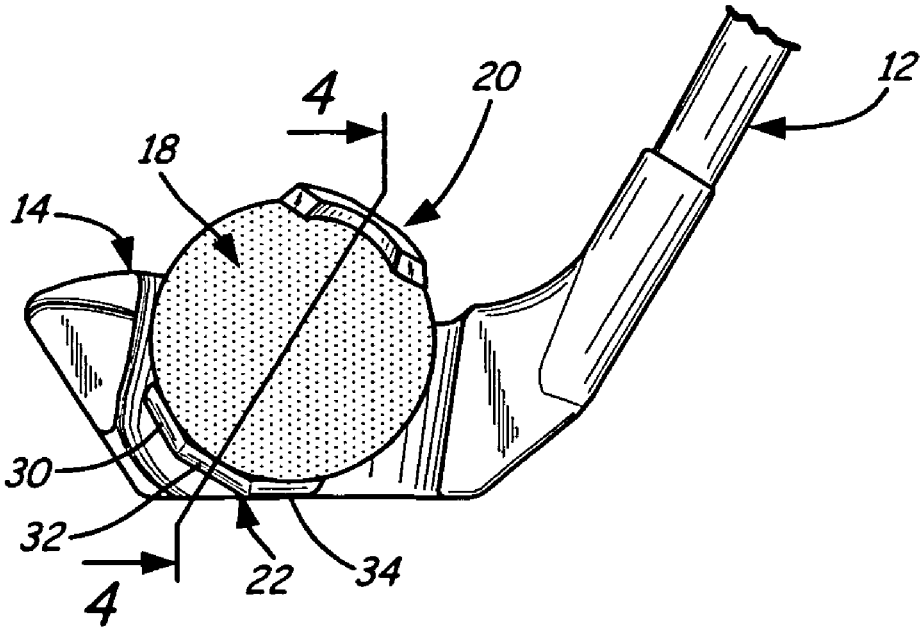
FIG. 3 is a side elevational view with the head portion retaining a ball.
Figure 4:
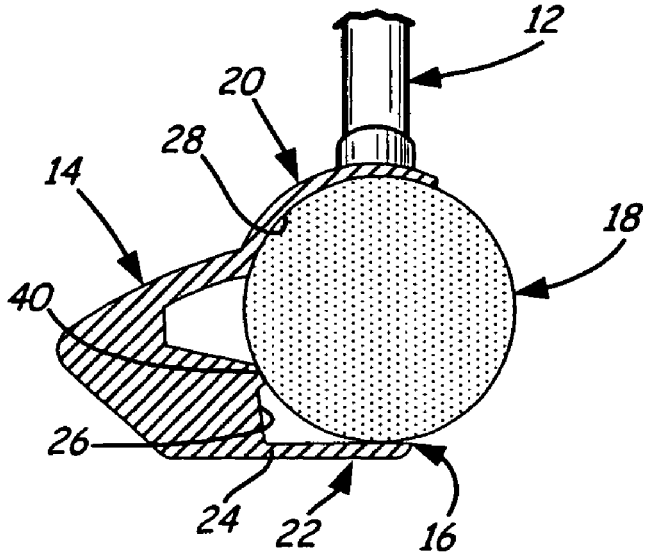
FIG. 4 is a sectional view taken along the line 4-4 in FIG. 3.

The socket 16 as best illustrated in FIGS. 2-4, includes upper and lower retaining members 20 and 22. The upper and lower retaining members are spaced sufficiently apart to engage the ball 18, as best illustrated in FIG. 3. The upper and lower retaining members engage the ball sufficiently to prevent the ball from falling free of the socket but yet permit release of the ball during the golf club swing. The upper and lower retaining members engage the ball only at the top and bottom which also aids in releasing the ball.

As illustrated in FIG. 4, the lower retaining member which forms a portion of a sole 24 of the club head 14 extends forwardly from a backwall 26 of the socket 16. The lower retaining member 22 is generally rigid. As further illustrated in FIG. 3, the lower retaining member 22 is made of three integral segments 30, 32 and 34 positioned at acute angles from each other. Each of the segments 30, 32 and 34 has a flat surface facing the ball 18. Each of the flat surfaces generally engages the ball 18 thereby providing a generally conforming structure to a lower portion of the ball 18.

In contrast, the upper retaining member 20 has an inner surface 28 that conforms to the spherical surface of the ball. The upper retaining member 20 is generally curving or arcuate in a cross-sectional shape and includes an aperture 21 centrally disposed thereon. In addition, the upper retaining member 20 is more flexible than the lower retaining member 22. The upper retaining member 20 is sufficiently flexible that it may be moved slightly when the ball is inserted into the socket 16.

Figure 5:
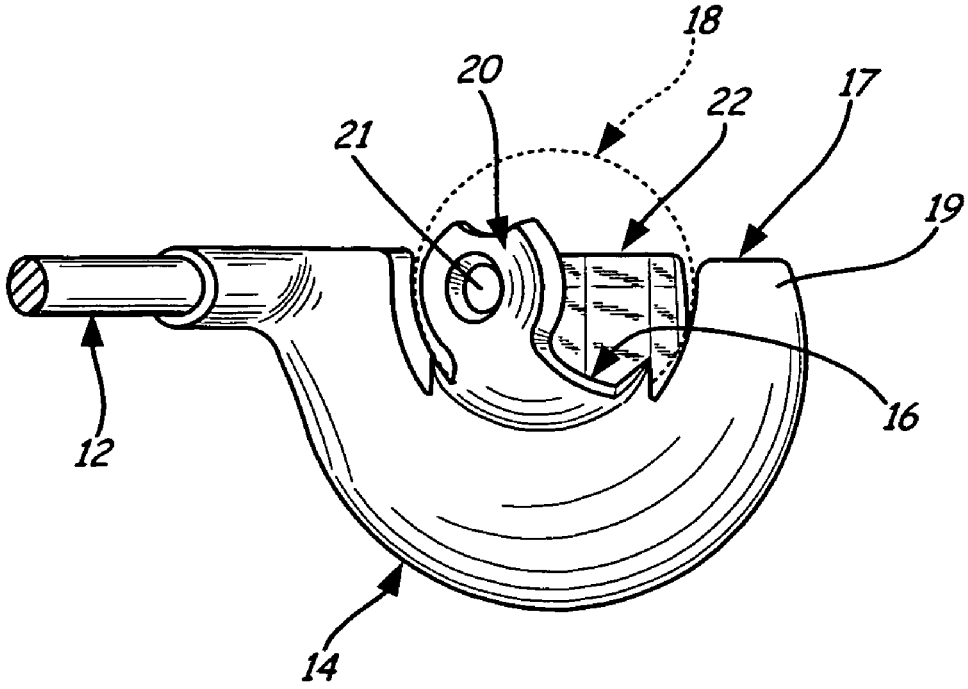
FIG. 5 is a top view of the head of the present invention.
Figure 6:
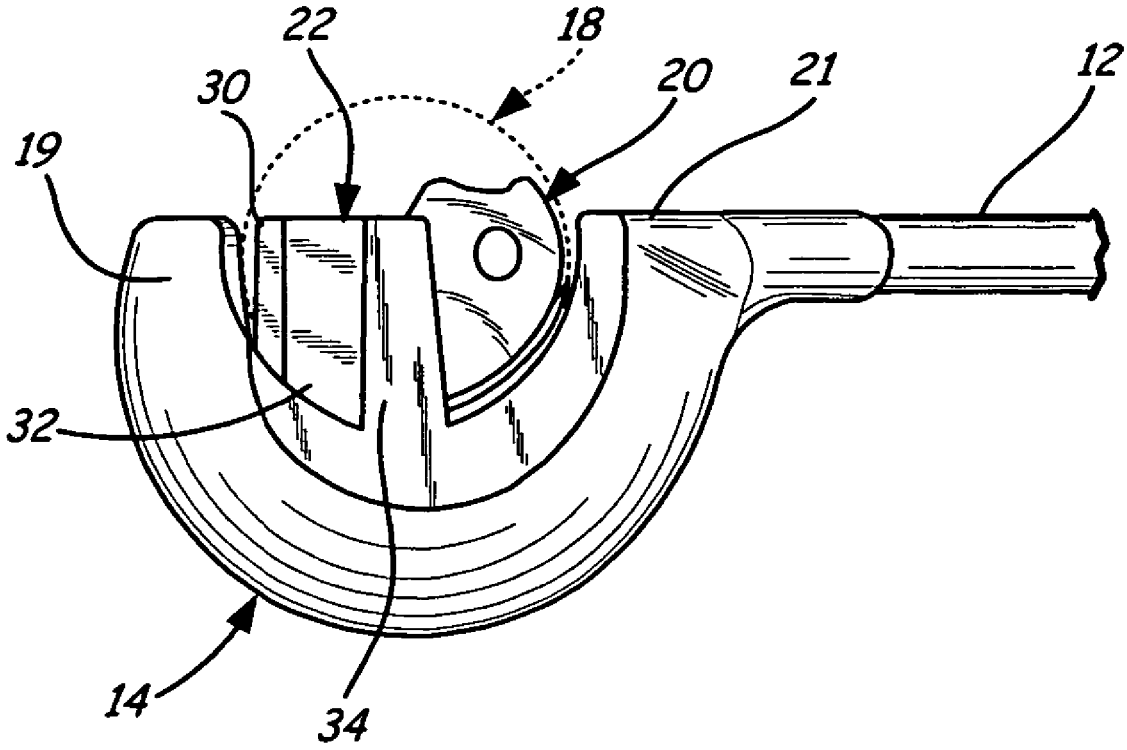
FIG. 6 is a bottom view of the device of the present invention.

The upper retaining member 20 is spaced a sufficient distance from the toe 19 of the head 14 large enough so that the thumb of the user can be placed on the ball 18, as illustrated in FIG. 5. Similarly, the lower retaining member 22 is spaced a distance from the heel portion 21 so that a finger can be placed on the ball, as illustrated in FIG. 6. Therefore, the ball 18 may be griped at positions 180° from each other to grasp the ball and pull the ball out of the socket 16 if needed.

The ball 18 in its usual form is a tennis ball. By tennis ball is meant a ball constructed of two half-shell pieces of formed rubber that are joined together by adhesive thereby having a hollow center. Two dumbbell shaped pieces of cloth are attached to the ball core by an adhesive. The tennis ball is typically pressurized, but does not necessarily have to be. The tennis ball when placed between the upper and lower retaining members is flexible enough to give a little so that the tennis ball can be positioned and secured within the socket.

The club also includes a recess 36 running parallel with the face of the club. The recess 36 has a cross-section parallel to the face of the club in the form of a parallelogram. The recess at its opening is boarded on three sides by wall portions 38, 40 and 42. The surfaces that face the ball of the wall portions 38, 40 and 42 conform to the contour of the ball 18.

In using the device of the present invention, the dog owner inserts a tennis ball into the socket. The device is then swung like a golf club. The dog owner grasps the grip portion of the shaft and takes a natural golf swing. The acceleration of the club portion during the swing is sufficient to launch the ball in a forward direction relative to the face of the head portion. The dog will then go after the ball and retrieve it back to the owner. In this manner, the dog retrieves the ball so the dog owner can stay in one place and swing the golf club device of the present invention. The dog in turn obtains exercise and enjoyment of retrieving the ball. The device eliminates the tediousness of repeatedly throwing a ball to a dog of which the dog never seems to tire of.

Although the present invention has been described with reference to preferred embodiments, workers skilled in the art will recognize that changes may be made in form and detail without departing from the spirit and scope of the invention.

What is claimed is:

1. A ball launching device for launching a ball, the device comprising:

a shaft;

a head attached to the shaft, the head including a face having a socket for releasably retaining the ball such that when the head is swung, the ball is released;

wherein the socket is defined by arcuate side walls provided by the face of the head extending between a toe and a heel of the head, and upper and lower retaining members which are adapted for engaging and retaining the ball;

wherein the lower retaining member is generally rigid; and wherein the upper retaining member is sufficiently flexible to permit flexure when the ball is positioned in the socket; and wherein the upper retaining member is positioned from the head sufficiently so that the ball may be engaged by a finger and the lower retaining member is positioned a distance sufficiently from a heel of the head so that the ball may be engaged by another finger sufficiently to grasp and remove the ball from the socket.

2. The device of claim 1 wherein the socket is sized to retain and release a tennis ball.

3. The device of claim 1 wherein the upper retaining member includes a ball facing surface that conforms to the balls outer surface.

4. The device of claim 1 wherein the upper and lower retaining members are positioned to engage the ball at an upper and a lower point of engagement.

5. The device of claim 1 wherein the upper retaining member has a ball engaging surface that conforms to the outer surface of the ball.

6. A ball launching device for launching a ball, the device comprising:

a shaft;

a head attached to the shaft, the head including a face having a socket for releasably retaining the ball such that when the head is swung, the ball is released;

wherein the socket is defined by arcuate side walls provided by the face of the head extending between a toe and a heel of the head, and upper and lower retaining members which are adapted for engaging and retaining the ball;

wherein the lower retaining member is generally rigid;

wherein the upper retaining member is sufficiently flexible to permit flexure when the ball is positioned in the socket; and wherein the arcuate sidewalls do not contact the ball.

7. A method of exercising a dog comprising:

providing a device having a handle and a head portion wherein the head portion, the head portion comprising:

a socket sufficient in size to releasably hold a ball;

wherein the socket is defined by arcuate sidewalls provided by the face of the head extending between a toe and a heel of the head, and upper and lower retaining members which are adapted for engaging and retaining the ball;

wherein the lower retaining member is generally rigid; and wherein the upper retaining member is sufficiently flexible to permit flexure when the ball is positioned in the socket; and swinging the device like a golf club sufficiently hard to release and launch the ball so that the dog may chase and retrieve the ball.

8. The method of claim 7 and further comprising:

placing the retrieved ball back into the socket and swinging the device again to launch the ball again.

* * * * *